US008770726B2

(12) United States Patent
Yamamoto

(10) Patent No.: US 8,770,726 B2
(45) Date of Patent: Jul. 8, 2014

(54) INKJET HEAD AND METHOD OF MANUFACTURING INKJET HEAD

(75) Inventor: Keizaburo Yamamoto, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 303 days.

(21) Appl. No.: 13/029,745

(22) Filed: Feb. 17, 2011

(65) Prior Publication Data

US 2012/0033018 A1 Feb. 9, 2012

(30) Foreign Application Priority Data

Aug. 5, 2010 (JP) ..... 2010-176576

(51) Int. Cl.

| | |
|---|---|
| ***B41J 2/045*** | (2006.01) |
| ***B41J 2/15*** | (2006.01) |
| ***B41J 2/145*** | (2006.01) |
| ***B41J 2/155*** | (2006.01) |

(52) U.S. Cl.

USPC ..... 347/71; 347/40; 347/42

(58) Field of Classification Search

None

See application file for complete search history.

(56) References Cited

U.S. PATENT DOCUMENTS

| | | | | |
|---|---|---|---|---|
| 2004/0080568 | A1* | 4/2004 | Matsuo et al. | 347/40 |
| 2009/0015640 | A1* | 1/2009 | Nishida et al. | 347/85 |

FOREIGN PATENT DOCUMENTS

| | | |
|---|---|---|
| JP | 2002-307678 | 10/2002 |
| JP | 2003-039661 | 2/2003 |
| JP | 2009-113501 | 5/2009 |
| JP | 2009-160822 | 7/2009 |

OTHER PUBLICATIONS

Machine Translation of JP2002307678, Oct. 2002, entire document.*

Japanese Office Action dated Jul. 23, 2013, filed in Japanese counterpart Application No. 2010-176576 (with English translation).

* cited by examiner

*Primary Examiner* — Lisa M Solomon

(74) *Attorney, Agent, or Firm* — Patterson & Sheridan, LLP

(57) ABSTRACT

According to one embodiment, an inkjet head includes a substrate, a nozzle plate which includes nozzle lines, each of which includes nozzles, the nozzles which are included in one of the nozzle lines and the nozzles which are included in another of the nozzle lines alternating with each other, and forming one imaginary nozzle line, piezoelectric members which are opposed to the respective nozzle lines, and groove parts which are provided in each of the piezoelectric members, the groove parts corresponding to the nozzles to eject ink from the nozzles and being processed by cutting edges, one of the groove parts which corresponds to one of the nozzles in the imaginary nozzle line and another of the groove parts which corresponds to another nozzle adjacent to the nozzle in the imaginary nozzle line being processed by the cutting edges which are independent of each other.

10 Claims, 10 Drawing Sheets

INKJET HEAD AND METHOD OF MANUFACTURING INKJET HEAD

CROSS-REFERENCE TO RELATED APPLICATIONS

This application is based upon and claims the benefit of priority from prior Japanese Patent Application No. 2010-176576, filed on Aug. 5, 2010, the entire contents of which are incorporated herein by reference.

FIELD

Embodiments described herein relate generally to an inkjet head and a method of manufacturing the inkjet head.

BACKGROUND

Some inkjet printers have an inkjet head in which ink circulates in a channel in the head. Inkjet heads of this type includes a supply port to which ink is supplied, and a discharge port from which ink is discharged. The inkjet heads have a plurality of piezoelectric elements which are arranged between the supply port and the discharge port.

Ink supplied from the supply port is ejected from nozzles of the inkjet head by piezoelectric elements. The nozzles are opposed to the piezoelectric elements. The remaining ink is recovered into an ink tank through the discharge port.

The piezoelectric elements are formed of, for example, lead zirconate titanate (PZT). Each piezoelectric element includes a plurality of groove parts, which are formed by machining, and a plurality of supports. By applying voltage to the supports, the pressure in the groove parts changes. Thereby, ink in the groove parts is ejected from the nozzles.

The piezoelectric elements are formed in a bar shape, and arranged in parallel with each other. Pressure chambers of the piezoelectric elements are formed of, for example, a dicing saw. A diamond wheel of a dicing saw moves to cross a plurality of piezoelectric elements. Thereby, groove parts are formed in the piezoelectric elements at a time.

The diamond wheel deteriorates due to, for example, wearing, during processing. When machining is performed with a worn diamond wheel, the groove parts are narrowed, and the supports are formed with an increased thickness. When the thickness of the supports increases, the deformation quantity of the supports when the voltage is applied decreases, and the quantity of ejected ink is also reduced. As described above, deterioration of the machining tool during processing may cause, for example, unevenness in density in printing.

DETAILED DESCRIPTION

In general, according to one embodiment, an inkjet head includes: a substrate; a nozzle plate which is opposed to the substrate, the nozzle plate including a plurality of nozzle lines, each of which includes a plurality of nozzles, the nozzles which are included in one of the nozzle lines and the nozzles which are included in another of the nozzle lines alternating with each other, and forming one imaginary nozzle line which is parallel with each of the nozzle lines; a plurality of piezoelectric members which are opposed to the respective nozzle lines; and a plurality of groove parts which are provided in each of the piezoelectric members, the groove parts corresponding to the nozzles to eject ink from the nozzles and being processed by a plurality of cutting edges, one of the groove parts which corresponds to one of the nozzles in the imaginary nozzle line and another of the groove parts which corresponds to another nozzle adjacent to the nozzle in the imaginary nozzle line being processed by the cutting edges which are independent of each other.

Figure 1:
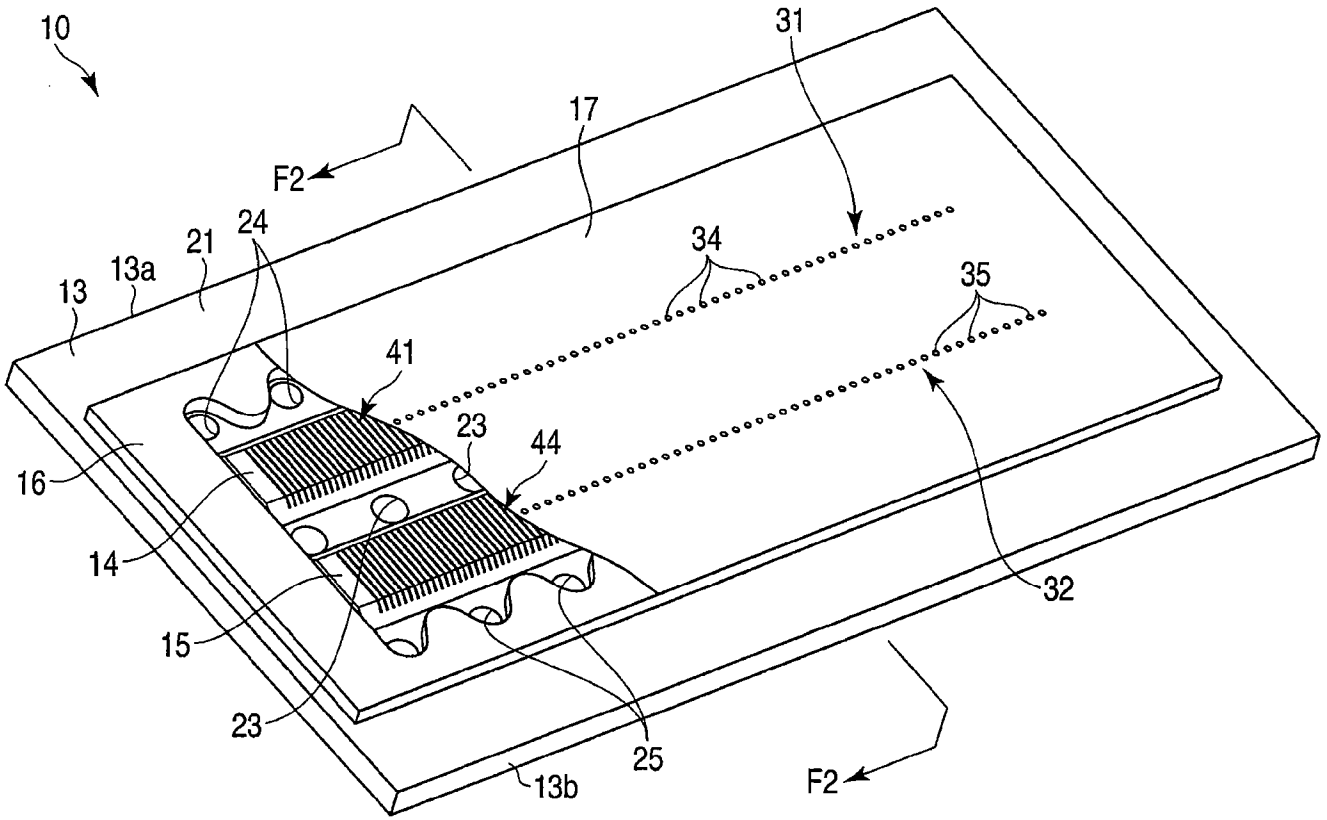
FIG. 1 is a perspective view of an inkjet head according to a first embodiment, a part of which is cut away.
Figure 2:
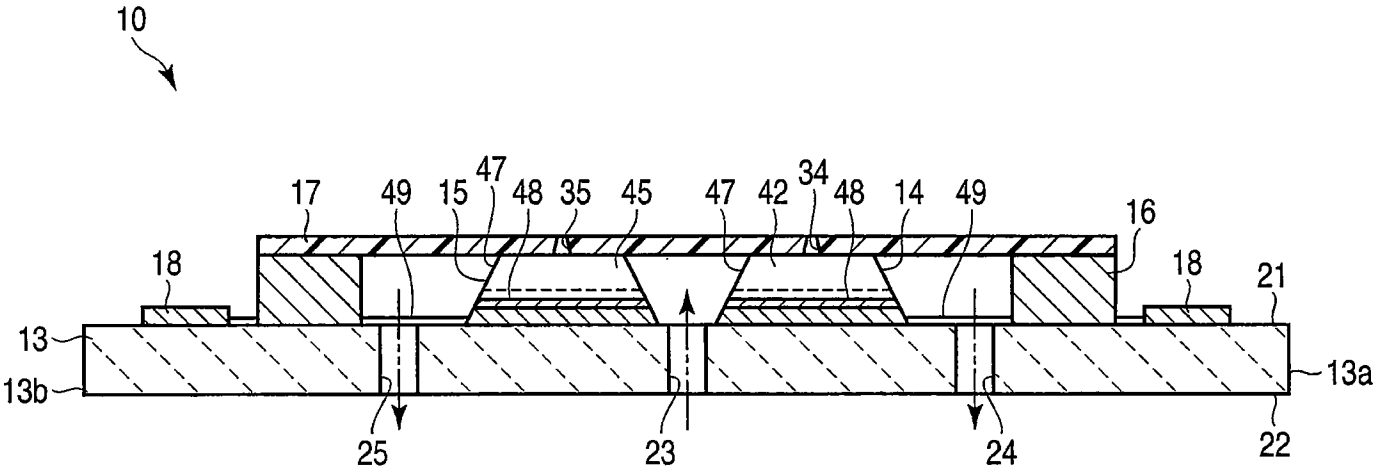
FIG. 2 is a cross-sectional view of the inkjet head according to the first embodiment, taken along line F2-F2 of FIG. 1.

A first embodiment will be explained hereinafter with reference to FIG. 1 to FIG. 7. FIG. 1 is a perspective view of an inkjet head 10 according to the first embodiment, part of which is cut away. FIG. 2 is a cross-sectional view of the inkjet head 10, taken along line F2-F2 of FIG. 1.

As illustrated in FIG. 1, the inkjet head 10 comprises a substrate 13, a first piezoelectric element 14, a second piezoelectric element 15, a frame member 16, and a nozzle plate 17. In addition, as illustrated in FIG. 2, the inkjet head 10 comprises ICs 18 to drive the first piezoelectric element 14 and the second piezoelectric element 15.

The substrate 13 is formed in a rectangular shape by ceramics such as alumina. The substrate 13 comprises a flat mounting surface 21, and a fixed surface 22 illustrated in FIG. 2. The fixed surface 22 is located reverse to the mounting surface 21. The fixed surface 22 is attached to, for example, a manifold of an inkjet printer. The substrate 13 comprises a plurality of supply ports 23, a plurality of first discharge ports 24, and a plurality of second discharge ports 25.

The supply ports 23 are arranged in a center part of the substrate 13, in a width direction of the substrate 13. The supply ports 23 are arranged in a line in a longitudinal direction of the substrate 13.

When the inkjet head 10 is attached to the manifold, the supply ports 23 are connected to an ink tank of the inkjet printer. Ink of the ink tank is supplied to the inkjet head 10 through the supply ports 23.

The first discharge ports 24 are arranged along one side edge 13*a* of the substrate 13. The first discharge ports 24 are arranged in a line in the longitudinal direction of the substrate 13. The second discharge ports 25 are arranged along the other side edge 13*b* of the substrate 13. The second discharge ports 25 are arranged in a line in the longitudinal direction of the substrate 13. The supply ports 23 are interposed between the first discharge ports 24 and the second discharge ports 25.

When the inkjet head 10 is attached to the manifold, the first discharge ports 24 and the second discharge ports 25 are connected to the ink tank. Ink in the inkjet head 10 is returned to the ink tank through the first discharge port 24 and the second discharge port 25.

The frame member 16 is attached to the mounting surface 21 without space between them, by bonding or the like. The frame member 16 surrounds the first piezoelectric element 14, the second piezoelectric element 15, the supply ports 23, the first discharge ports 24, and the second discharge ports 25.

The nozzle plate 17 is formed of a rectangular film made of polyimide. The nozzle plate 17 is not limited to it, but may be formed of other materials such as nickel, stainless, and polysulfone. The nozzle plate 17 is attached to the frame member 16 without space between them, by bonding or the like. The nozzle plate 17 is opposed to the mounting surface 21 of the substrate 13.

The nozzle plate 17 comprises a first nozzle line 31 and a second nozzle line 32. The first nozzle line 31 includes a plurality of first nozzles 34. The first nozzles 34 are arranged in a line, and form the first nozzle line 31. A distance between adjacent first nozzles is, for example, 0.169 mm. The distance between adjacent first nozzles 34 is referred to as "1 pitch" hereinafter.

The second nozzle line 32 includes a plurality of second nozzles 35. The second nozzles 35 are arranged in a line, and form the second nozzle line 32. A distance between adjacent second nozzles 35 is 1 pitch. The first nozzle line 31 and the second nozzle line 32 are arranged in parallel with each other, and extend in the longitudinal direction of the nozzle plate 17.

The first piezoelectric member 14 is attached to the mounting surface 21 of the substrate 13, and extends in the longitudinal direction of the substrate 13. The first piezoelectric member 14 is disposed between the supply ports 23 and the first discharge ports 24. The first piezoelectric member 14 faces the first nozzle line 31.

The second piezoelectric member 15 is attached to the mounting surface 21 in parallel with the first piezoelectric member 14. The second piezoelectric member 15 is disposed between the supply ports 23 and the second discharge ports 25. The second piezoelectric member 15 faces the second nozzle line 32. A distance between the first piezoelectric member 14 and the second piezoelectric member 15 is, for example, 5 mm.

Each of the first piezoelectric member 14 and the second piezoelectric member 15 is formed of, for example, two piezoelectric plates which are bonded to each other and formed of lead zirconate titanate (PZT). Polarizing direction of the two piezoelectric plates are opposed to each other. As illustrated in FIG. 2, each of the first piezoelectric member 14 and the second piezoelectric member 15 is formed in a bar shape which has a trapezoidal cross section.

Figure 3:
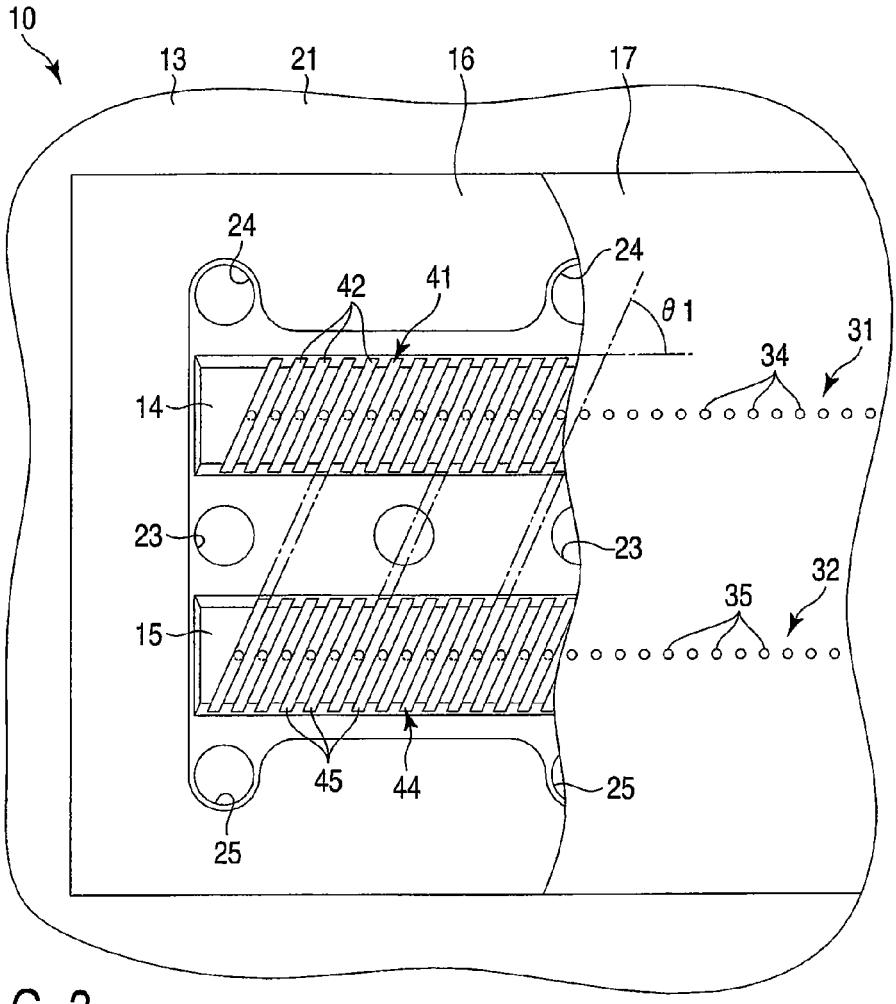
FIG. 3 is a plan view of the inkjet head according to the first embodiment, a part of which is cut away.
Figure 4:
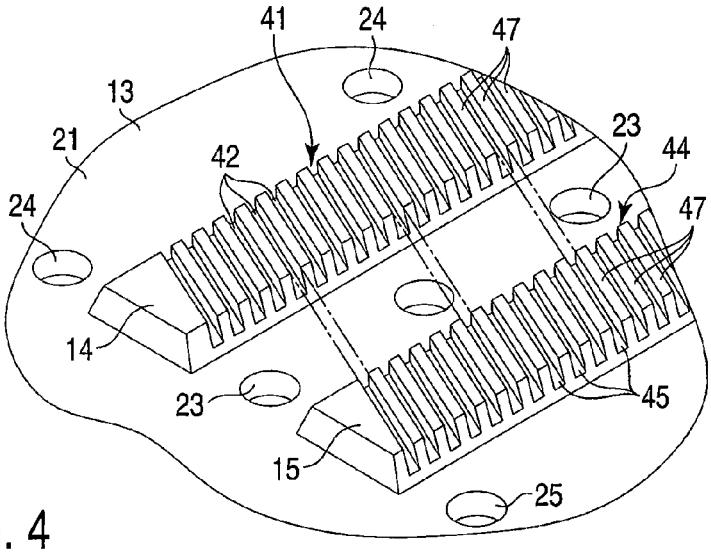
FIG. 4 is a perspective view of a substrate and first and second piezoelectric elements according to the first embodiment.

FIG. 3 is a plan view of the inkjet head 10, part of which is cut away. FIG. 4 is a perspective view illustrating the substrate 13, the first piezoelectric member 14, and the second piezoelectric member 15. As illustrated in FIG. 4, the first piezoelectric member 14 comprises a first groove line 41. The first groove line 41 includes a number of first groove parts 42 for ink ejection. As illustrated in FIG. 2, the first groove parts 42 are formed in positions corresponding to respective first nozzles 34.

As illustrated in FIG. 3, the first groove parts 42 are arranged in a line in the direction in which the first piezoelectric member 14 extends. Each of the first groove parts 42 extends inclinedly with respect to the direction in which the first piezoelectric member 14 extends. A distance between adjacent first groove parts 42 is 1 pitch. An incline θ1 between the direction in which the first piezoelectric member 14 extends and the direction in which the first groove parts 42 extend is, for example, 81°.

The second piezoelectric member 15 comprises a second groove line 44. The second groove line 44 includes a number of second groove parts 45 for ink ejection. As illustrated in FIG. 2, the second groove parts 45 are formed in positions corresponding to respective second nozzles 35.

As illustrated in FIG. 3, the second groove parts 45 are arranged in a line in a direction in which the second piezoelectric member 15 extends. Each of the second groove parts 45 extends in the same direction as the direction in which the first groove parts 42 extend. Each second groove part 45 is provided on the same straight line as corresponding one first groove part 42.

As illustrated in FIG. 2, each of the first piezoelectric member 14 and the second piezoelectric member 15 has a plurality of supports 47 and a plurality of electrodes 48. As illustrated in FIG. 4, the supports 47 are provided on both sides of each first groove part 42 and both sides of each second groove part 45, and function as driving elements. The electrodes 48 are formed on side surfaces of the supports 47 and bottom surfaces of the first groove parts 42 and the second groove parts 45.

As illustrated in FIG. 2, the electrodes 48 are electrically connected to the IC 18 through electric wires 49 provided on the mounting surface 21. A printing signal is inputted to the IC 18 by user's operation. Based on the printing signal, the IC 18 applies a driving pulse voltage to the electrodes 48 through the electric wires 49. When the voltage is applied to the electrodes 48, the supports 47 perform share mode deformation, and move away to curve. Then, when the supports 47 return to the initial positions, the pressure in the first groove parts 42 and the second groove parts 45 increases. Thereby, ink drops are ejected with great force from the first nozzles 34 and the second nozzles 35.

Figure 5:
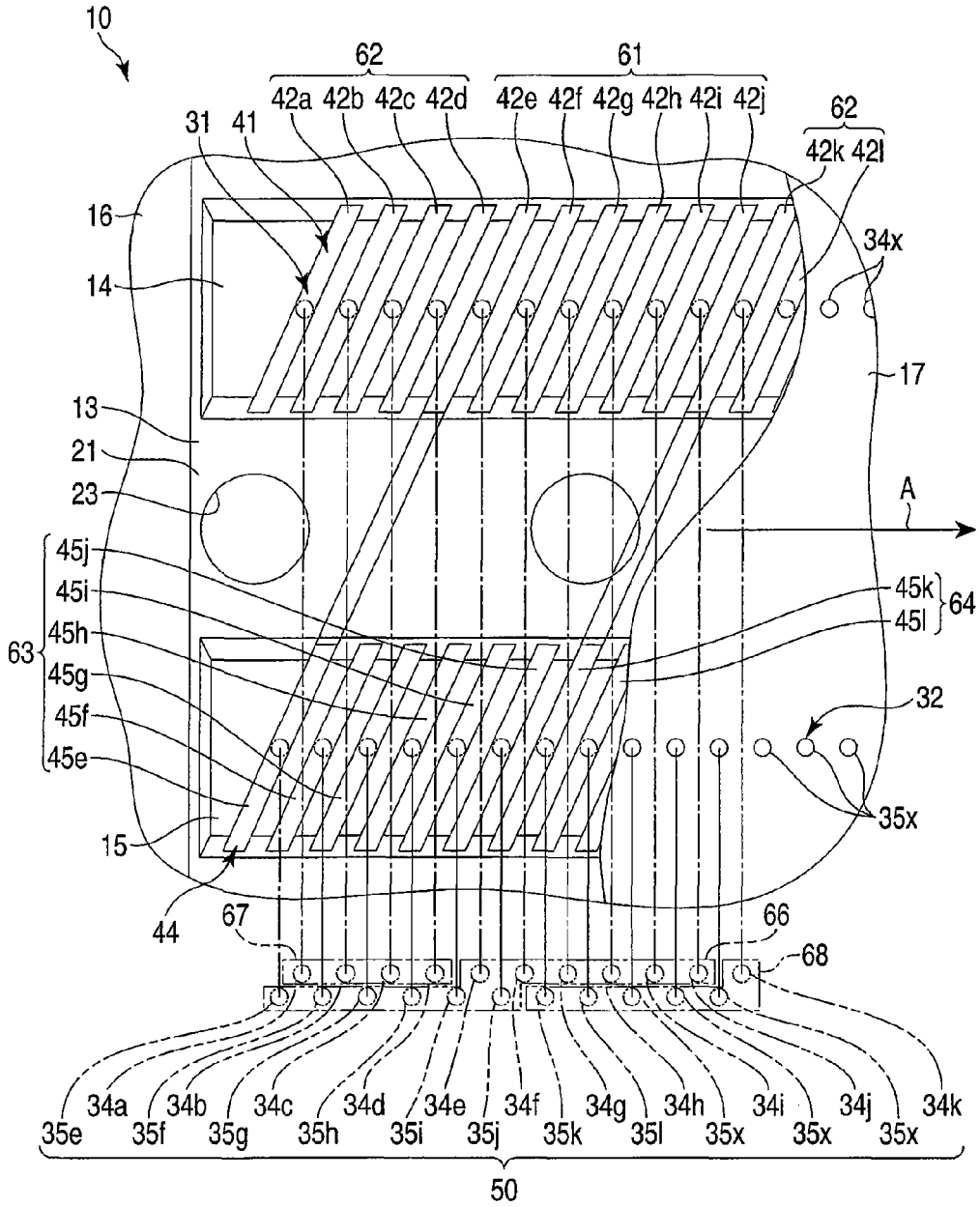
FIG. 5 is a plan view for explaining arrangement of first and second nozzles according to the first embodiment.

FIG. 5 is a plan view for explaining arrangement of the first nozzles 34 and the second nozzles 35. In FIG. 5, the first nozzles 34 are denoted by chain double-dashed lines on corresponding first groove parts 42. The second nozzles 35 are denoted by chain double-dashed lines on corresponding second groove parts 45. In addition, the first nozzles 34 and the second nozzles 35 are imaginarily illustrated in lines in the lower part of FIG. 5. Correlations between the first nozzles 34 illustrated on the first groove parts 42 and the first nozzles 34 illustrated in the lower part of FIG. 5 are denoted by chain lines. In the same manner, correlations between the second nozzles 35 illustrated on the second groove parts 45 and the second nozzles 35 illustrated in the lower part of FIG. 5 are denoted by chain lines.

Figure 6:
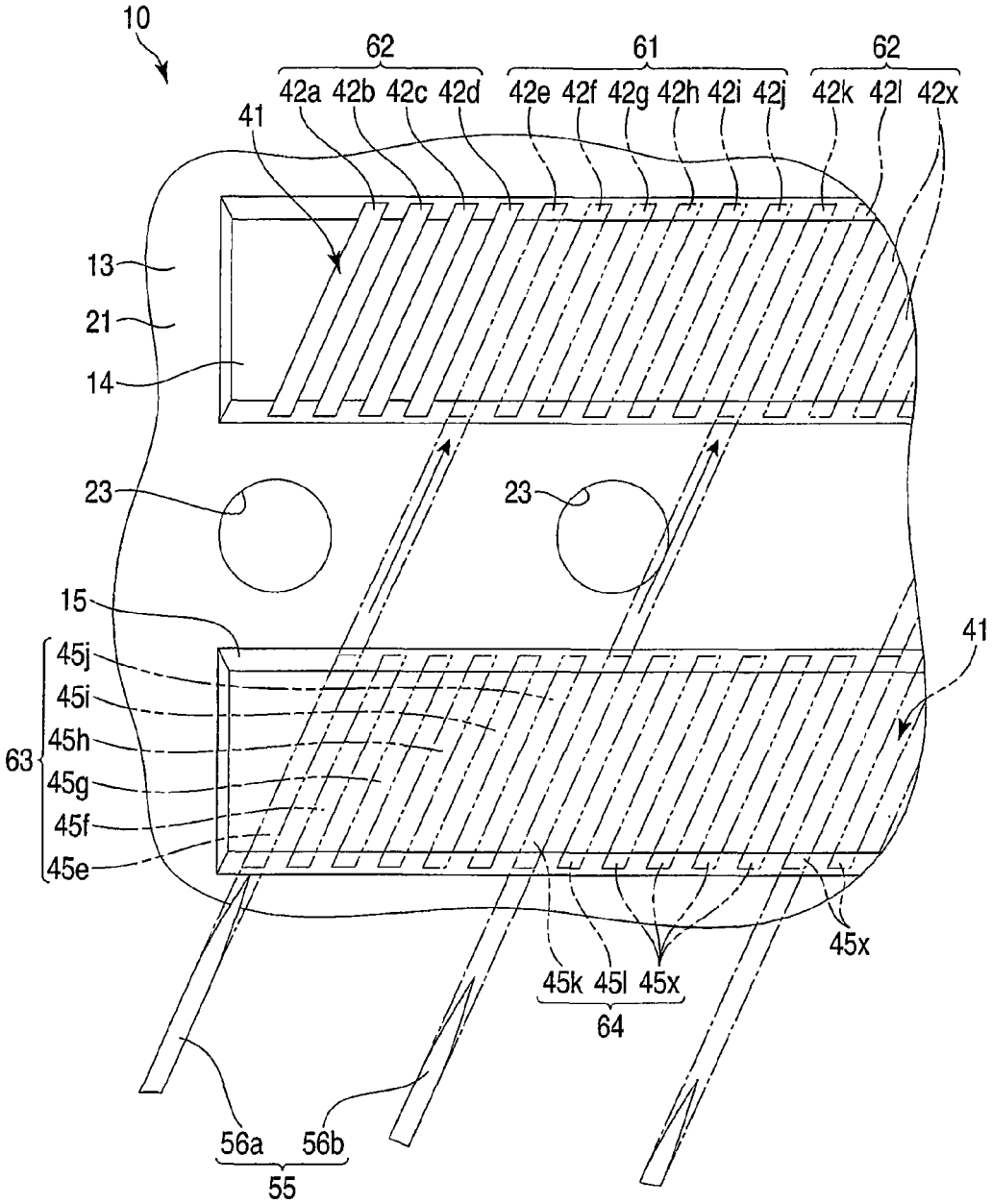
FIG. 6 is a plan view illustrating an initial stage of processing of the first and second piezoelectric elements according to the first embodiment.
Figure 7:
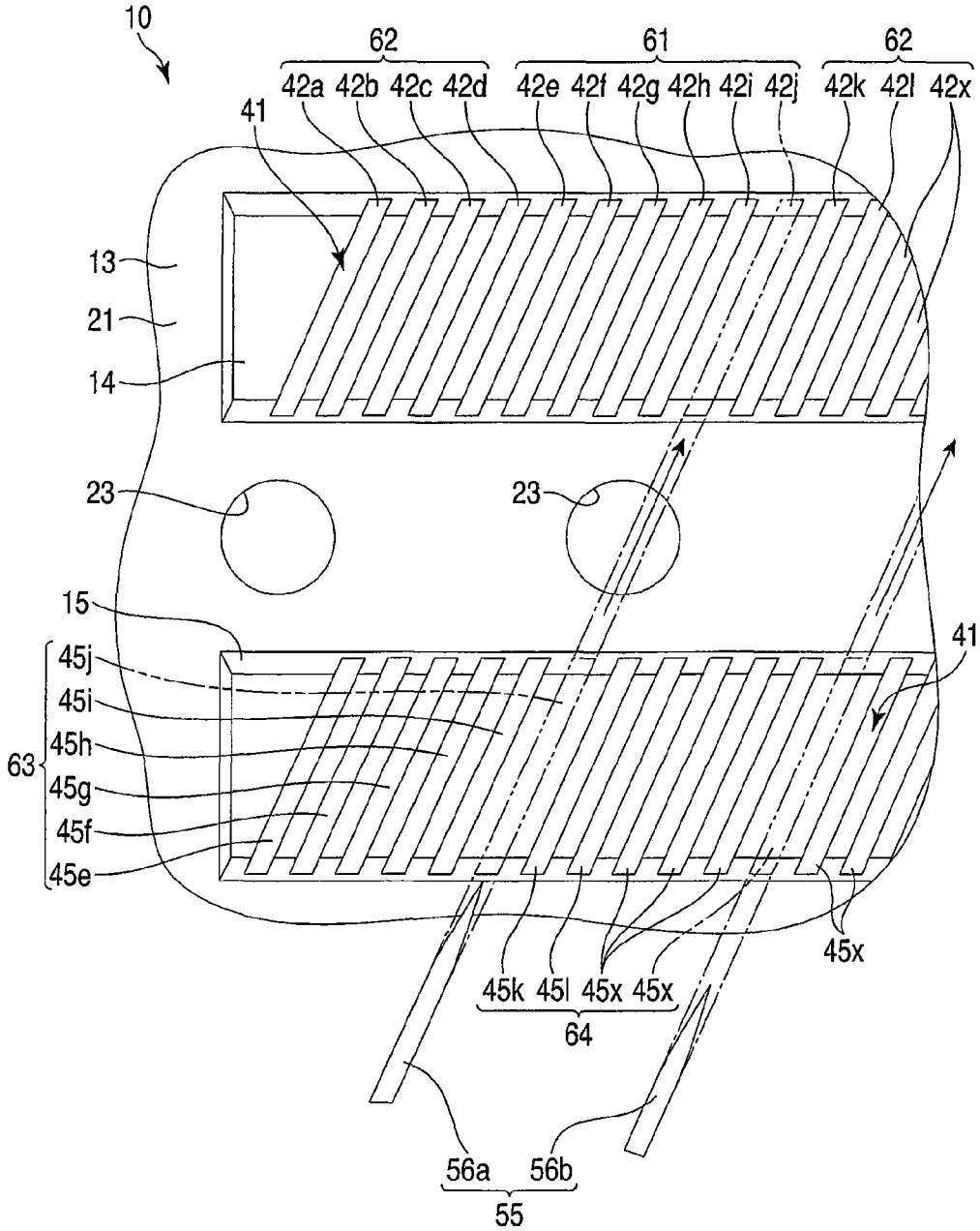
FIG. 7 is a plan view illustrating a last stage of processing of the first and second piezoelectric elements according to the first embodiment.

In FIG. 5 to FIG. 7 and the following description, the first nozzles 34 are referred to as first nozzles 34*a*, 34*b*, 34*c*, 34*d*, 34*e*, 34*f*, 34*g*, 34*h*, 34*i*, 34*j*, and 34*k* and a plurality of first nozzles 34*x* provided in order from the edge, for convenience. The second nozzles 35 are referred to as second nozzles 35*e*, 35*f*, 35*g*, 35*h*, 35*i*, 35*j*, 35*k* and 35*l* and a plurality of second nozzles 35*x* provided in order from the edge. The first groove parts 42 are referred to as second groove parts 42*a*, 42*b*, 42*c*, 42*d*, 42*e*, 42*f*, 42*g*, 42*h*, 42*i*, 42*j*, 42*k* and 42*l* and a plurality of first groove parts 42*x* provided in line from the edge. The second groove parts 45 are referred to as second groove parts 45*e*, 45*f*, 45*g*, 45*h*, 45*i*, 45*j*, 45*k* and 45*l* and a plurality of second groove parts 45*x* provided in order from the edge. If necessary, they are referred to as the first nozzles 34, the second nozzles 35, the first groove parts 42, and the second groove parts 45, as described above.

As illustrated in FIG. 5, the first nozzles 34 included in the first nozzle line 31 and the second nozzles 35 included in the second nozzle line 32 form a imaginary nozzle line 50. The imaginary nozzle line 50 is formed by the first nozzles 34 and the second nozzles 35 which are imaginarily arranged in a line, in a direction denoted by arrow A in FIG. 5, in which the first nozzle line 31 extends. FIG. 5 illustrates the imaginary nozzle line 50 in a meandering manner, for convenience.

The imaginary nozzle line 50 extends in parallel with the first nozzle line 31 and the second nozzle line 32. In the imaginary nozzle line 50, the first nozzles 34 and the second nozzles 35 are alternately arranged. In the imaginary nozzle line 50, a distance between the first nozzles 34 and the second nozzles 35 is 0.5 pitches.

In addition, in the imaginary nozzle line 50, one first nozzle 34 corresponds to a first groove part 42. The first groove part 42 is shifted by 5 pitches from the first groove part 42 which is located in the same straight line as the second groove part 45 to which the second nozzle 35 adjacent to the first nozzle 34 corresponds. Specifically, the first nozzle 34*a* corresponds to the first groove part 42*a*. The first nozzle 34*a* is adjacent to the second nozzle 35*f*. The second nozzle 35*f* corresponds to the second groove part 45*f*. The second groove part 45*f* is located on the same straight line as the first groove part 42*f*. the first groove part 42*f* is shifted by 5 pitches from the first groove part 42*a*.

In other words, in the imaginary nozzle line 50, between a first nozzle 34 corresponding to one first groove part 42 and a second nozzle 35 corresponding to a second groove part 45 which is provided on the same straight line as the first groove part 42, there are at least one first nozzle 34 and at least one second nozzle 35. Specifically, as illustrated in FIG. 5, the first groove part 42*e* corresponds to the first nozzle 34*e*. The second groove part 45*e* corresponds to the second nozzle 35*e*. There are a plurality of first nozzles 34*a*, 34*b*, 34*c*, 34*d* and a plurality of second nozzles 35*f*, 35*g*, 35*h*, and 35*i* between the first nozzle 34*e* and the second nozzle 35*e*. The second groove part 45*e* is provided on the same straight line as the first groove part 42*e*.

From another point of view, in the imaginary nozzle line 50, a first groove part 42 which corresponds to one first nozzle 34 is different from a first groove part 42 that is located on the same straight line as a second groove part 45 which corresponds to a second nozzle 35 adjacent to the first nozzle 34. Specifically, the first nozzle 34*e* corresponds to the first groove part 42*e*. Second nozzles 35*i* and 35*j* which are adjacent to the first nozzle 34*e* correspond to second groove parts 45*i* and 45*j*, respectively. First groove parts 42*i* and 42*j* which are located on the same straight lines as the second groove parts 45*i* and 45*j*, respectively, are different from the first groove part 42*e*.

The positional relation between the first nozzles 34, the second nozzles 35, the first groove parts 42, and the second groove parts 45 described above is also applicable to the other first nozzles 34, second nozzles 35, first groove parts 42, and second groove parts 45.

The following is explanation of a method of manufacturing the inkjet head 10 having the above structure. First, supply ports 23, first discharge ports 24, and second discharge ports 25 are formed by press molding in a substrate 13 which is formed of a ceramics sheet (ceramics green sheet) before sintering. Then, the substrate 13 is sintered.

Next, a first piezoelectric member 14 and a second piezoelectric member 15 are bonded to the substrate 13. In bonding, a fixed distance between the first piezoelectric member 14 and the second piezoelectric member 15 is maintained by jig. The first piezoelectric member 14 and the second piezoelectric member 15 are positioned to the substrate 13 by the jig, and bonded to the substrate 13. Thereafter, corner parts of the first piezoelectric member 14 and the second piezoelectric member 15 bonded to the substrate 13 are tapered. Thereby, the first piezoelectric member 14 and the second piezoelectric member 15 have trapezoidal cross sections as illustrated in FIG. 2.

Next, a first groove line 41 and a second groove line 44 are formed on the first piezoelectric member 14 and the second piezoelectric member 15, respectively. FIG. 6 is a plan view illustrating the first piezoelectric member 14 and the second piezoelectric member 15 at the initial stage of processing. FIG. 7 is a plan view illustrating the first piezoelectric member 14 and the second piezoelectric member 15 at the last stage of processing. The following is specific explanation of the step of forming the first groove line 41 and the second groove line 44.

The first groove part 42 and the second groove part 45 are formed by, for example, a multicutter 55 of a dicing saw which is used for cutting IC wafers. As illustrated in FIG. 6, the multicutter 55 includes two diamond wheels 56*a* and 56*b*, and a plurality of other diamond wheels. The diamond wheels 56*a* and 56*b* are an example of a plurality of cutting edges, and are independent of each other.

The diamond wheels 56*a* and 56*b* are arranged in parallel with each other. The diamond wheels 56*a* and 56*b* are arranged apart from each other. The two diamond wheels 56*a* and 56*b* can form, by one straight movement, two first groove parts 42 and two second groove parts 45 together, which are distant from each other by, for example, 6 pitches. The other diamond wheels included in the multicutter 55 are distant from each other by the same distance.

First, the multicutter 55 is moved in a straight line in a direction which crosses the first piezoelectric member 14, and thereby first groove parts 42*a*, 42*b*, 42*c*, and 42*d* are formed by the diamond wheels. Thereby, the first piezoelectric member 14 comes to a state illustrated in FIG. 6.

Next, the multicutter 55 is moved in a straight line to obliquely cross the first piezoelectric member 14 and the second piezoelectric member 15 which are adjacent to each other. Thereby, the first groove part 42*e* and the second groove part 45*e* are formed by the diamond wheel 56*a*, and the first groove part 42*k* and the second groove part 45*k* are formed by the diamond wheel 56*b*. One first groove part 42*e* and the other first groove part 42*k* are distant from each other by 6 pitches. One second groove part 45*e* and the other second groove part 45*k* are also distant from each other by 6 pitches. A plurality of first groove parts 42*x* and a plurality of second groove parts 45*x* which are provided by 6 pitches are also formed by other diamond wheels of the multicutter 55. Specifically, first groove parts 42*e*, 42*k*, and 45*x* and second groove parts 45*e*, 45*k*, and 45*x* are formed together.

Then, the multicutter 55 are moved in a straight line five times, and thereby the first groove parts 42*f*, 42*g*, 42*h*, and 42*i* and second groove parts 45*f*, 45*g*, 45*h*, and 45*i* are formed in order by the diamond wheel 56*a*. Simultaneously, the first groove parts 42*l* and 42*x* and the second groove parts 45*l* and 45*x* are formed in order by the diamond wheel 56*b*. A plurality of first groove parts 42*x* and a plurality of second groove parts 45*x* are also formed in order at 6 pitches by other diamond wheels of the multicutter 55. Thereby, the first piezoelectric member 14 and the second piezoelectric member 15 come to the state illustrated in FIG. 7.

Next, the multicutter 55 is moved in a straight line, and thereby the first groove part 42*j* and the second groove part

45*j* are formed by the diamond wheel 56*a*, and one first groove part 42*x* and one second groove part 45*x* are formed by the diamond wheel 56*b*. The other first groove parts 42*x* and the other second groove parts 45*x* are also formed by other diamond wheels of the multicutter 55. Thereby, the first piezoelectric member 14 and the second piezoelectric member 15 come to the state illustrated in FIG. 4, and thereby the first groove line 41 and the second groove line 44 are formed.

Next, electrodes 48 are formed in respective internal surfaces of the first groove parts 42 and the second groove parts 45. Then, electric wires 49 are formed on the mounting surface 21 of the substrate 13. The electrodes 48 and the electric wires 49 are formed of, for example, a nickel thin film which is formed by non-electrolytic plating.

Next, patterning is performed by laser irradiation, and the nickel thin film is removed from parts other than the electrodes 48 and the electric wires 49. Then, a frame member 16 is bonded to the substrate 13. Thereafter, a nozzle plate 17 is bonded to the frame member 16. Next, the nozzle plate 17 is irradiated with laser to form first nozzles 34 and second nozzles 35. Then, IC 18 is fixed onto the mounting surface 21 of the substrate 13 to be connected to the electric wires 49, and thereby the manufacturing process of the inkjet head 10 is finished.

After the first groove line 41 and the second groove line 44 are formed as described above, the first groove parts 42 and the second groove parts 45 have the following arrangement. As illustrated in FIG. 5 and FIG. 6, in the imaginary nozzle line 50, the first nozzle 34*f* is adjacent to the second nozzle 35*k*. The first nozzle 34*f* corresponds to the first groove part 42*f*. The second nozzle 35*k* corresponds to the second groove part 45*k*. The first groove part 42*f* is processed by one diamond wheel 56*a*. The second groove part 45*k* is processed by the other diamond wheel 56*b*. In other words, in the present embodiment, in the imaginary nozzle line 50, one first groove part 42*f* which corresponds to one first nozzle 34*f* and the other second groove part 45*k* which corresponds to one second nozzle 35*k* adjacent to the first nozzle 34*f* are processed by diamond wheels 56*a* and 56*b*, respectively, which are independent of each other. Therefore, it is possible to suppress influence by deterioration of diamond wheels in comparison with the case where all the groove parts corresponding to adjacent nozzles in the imaginary nozzle line are processed by the same diamond wheel.

In addition, the first groove part 41 includes a first groove group 61 and a second groove group 62. The first groove group 61 is an example of one groove group. The second groove group 62 is an example of the other groove group. The first groove group 61 includes first groove parts 42*e*, 42*f*, 42*g*, 42*h*, 42*i*, and 42*j* which are processed by the diamond wheel 56*a*. The second groove group 62 includes first groove parts 42*a*, 42*b*, 42*c*, 42*d*, 42*k*, 42*l*, and 42*x* which are processed by the diamond wheel 56*b* and the other diamond wheels of the multicutter 55.

The second groove part 44 includes a third groove group 63 and a fourth groove group 64. The third groove group 63 is an example of one groove group. The fourth groove group 64 is an example of the other groove group. The third groove group 63 includes second groove parts 45*e*, 45*f*, 45*g*, 45*h*, 45*i*, and 45*j* which are processed by the diamond wheel 56*a*. The fourth groove group 64 includes second groove parts 45*k*, 45*l*, and 45*x* which are processed by the diamond wheel 56*b* and the other diamond wheels of the multicutter 55.

The imaginary nozzle line 50 includes a first nozzle group 66, a second nozzle group 67, and a third nozzle group 68. The first nozzle group 66 is an example of one nozzle group. The second nozzle group 67 is an example of another nozzle group. The third nozzle group 68 is also an example of another nozzle group.

The first nozzle group 66 corresponds to the first groove group 61 and the third groove group 63. The first nozzle group 66 includes the first nozzles 34*e*, 34*f*, 34*g*, 34*h*, 34*i*, and 34*j* and the second nozzles 35*e*, 35*f*, 35*h*, 35*i*, and 35*j*.

The second nozzle group 67 corresponds to the second groove group 62. The second nozzle group 67 includes the first nozzles 34*a*, 34*b*, 34*c*, and 34*d*. the third nozzle group 68 corresponds to the second groove group 62 and the fourth groove group 64. The third nozzle group 68 includes the first nozzles 34*k*, 34*l*, and 34*x* and the second nozzles 35*k*, 351, and 35*x*.

As illustrated in FIG. 5, five second nozzles 35*e*, 35*f*, 35*g*, 35*h*, and 35*i* which are located in one end part of the first nozzle group 66 alternate with four first nozzles 34*a*, 34*b*, 34*c* and 34*d* of the second nozzle group 67. Five first nozzles 34*f*, 34*g*, 34*h*, 34*i*, and 34*j* which are located in the other end part of the first nozzle group 66 alternate with five second nozzles 35*k*, 35*l* and 35*x* which are located in an end part of the third nozzle group 68.

According to the inkjet head 10 having the above structure, it is possible to make unevenness of density in printing inconspicuous even when machining properties of the diamond wheels 56*a* and 56*b* and the other diamond wheels of the multicutter 55 are different from each other.

Suppose that the diamond wheel 56*a* forms groove parts thicker than the planned thickness, and the diamond wheel 56*b* forms groove parts narrower than the planned thickness. The first groove group 61 and the second groove group 62 which are formed by the diamond wheel 56*a* eject ink more than a predetermined quantity from the corresponding first nozzle group 66. Therefore, parts which are printed by the first nozzle group 66 are thickly printed.

The second groove group 62 and the fourth groove group 64 which are formed by the diamond wheel 56*b* eject ink less than the predetermined quantity from the corresponding third nozzle group 68. Therefore, parts which are printed by the third nozzle group 68 are thinly printed.

In a boundary part between the first nozzle group 66 and the third nozzle group 68, the five first nozzles 34*f*, 34*g*, 34*h*, 34*i*, and 34*j* located in the end part of the first nozzle group 66 alternate with the five second nozzles 35*k*, 35*l*, and 35*x* located at the end part of the third nozzle group 68. Therefore, the part which is printed by the boundary part between the first nozzle group 66 and the third nozzle group 68 includes thickly printed parts and thinly printed parts which alternate with each other, and appears to have medium thickness.

As described above, the part which is printed with medium thickness by the boundary part between the first nozzle group 66 and the third nozzle group 68 is interposed between the part which is thickly printed by the first nozzle group 66 and the part which is thinly printed by the third nozzle group 68. This prevents unevenness in density in printing due to difference in property of individual diamond wheels from standing out.

In addition, each diamond wheel of the multicutter 55 deteriorates due to wearing in machining. Therefore, as machining is performed, difference in property occurs between the individual diamond wheels. According to the inkjet head 10 having the above structure, it is possible to make unevenness in density in printing inconspicuous, even when difference in property between the individual diamond wheels occurs due to such deterioration.

Next, a second embodiment will be explained hereinafter with reference to FIG. 8 to FIG. 12. Constituent elements having the same function as the inkjet head 10 of the first embodiment are denoted by the same respective reference numerals, and explanation thereof is omitted.

Figure 8:
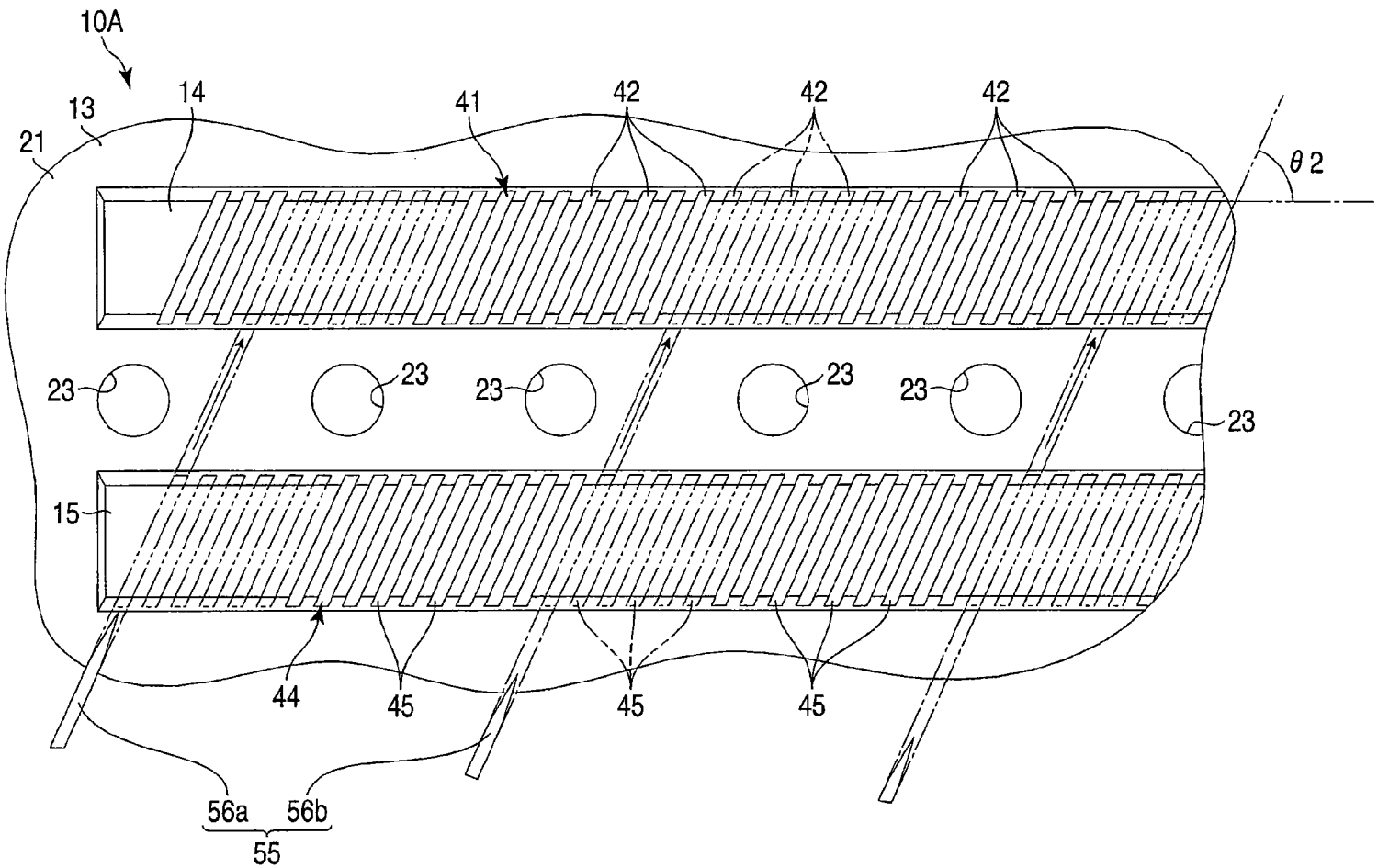
FIG. 8 is a plan view of an inkjet head which is being processed according to a second embodiment.

FIG. 8 is a plan view of a first piezoelectric member 14 and a second piezoelectric member 15 of an inkjet head 10A which is being processed according to a second embodiment. In the inkjet head 10A of the second embodiment, inclination 82 between a direction in which the first piezoelectric member 14 extends and a direction in which first groove parts 42 extend is, for example, 77°.

The number of the first groove parts 42 is, for example, about 150. The number of second groove parts 45 is also, for example, about 150. The number of first nozzles 34 which correspond to the first groove part 42 is, for example, about 150. The number of second nozzles 35 which correspond to the second groove parts 45 is also, for example, 150. Therefore, the imaginary nozzle line 50 is formed of about 300 nozzles.

The first groove parts 42 and the second groove parts 45 are formed by, for example, a multicutter 55. The multicutter 55 includes 11 diamond wheels. Two diamond wheels 56*a* and 56*b* included in the multicutter 55 form two first groove parts 42 and two second groove parts 45 together, which are distant from each other by, for example, 15 pitches, by one straight-line movement. The other diamond wheels included in the multicutter 55 are distant from each other by the same distance.

In a boundary part between a first nozzle group 66 and a third nozzle group 68, a plurality of first nozzles 34 which are located in an end part of the first nozzle group 66 alternate with a plurality of second nozzles 35 which are located in an end part of the third nozzle group 68. Therefore, a part which is printed by the boundary part between the first nozzle group 66 and the third nozzle group 68 is formed of alternating parts which have different printing thicknesses, and appears to have medium thickness.

Therefore, a part which is printed with medium thickness by the boundary part between the first nozzle group 66 and the third nozzle group 68 is interposed between the part printed by the first nozzle group 66 and the part printed by the third nozzle group 68. Thereby, unevenness in density in printing due to difference in property between the individual diamond wheels is made inconspicuous.

The following is a specific example of printing property of the inkjet head 10A having the above structure, with reference to a general example.

TABLE 1

| Diamond wheel No. | Number of machined groove parts | Difference from designed size: Lower groove part | Difference from designed size: Upper groove part |
|---|---|---|---|
| 1 | 15 | +1% | +2% |
| 2 | 30 | +0% | +2% |
| 3 | 30 | +0% | +2% |
| 4 | 30 | +1% | +4% |
| 5 | 30 | +0% | +2% |
| 6 | 30 | +1% | +2% |
| 7 | 30 | −1% | +4% |
| 8 | 30 | +0% | +2% |
| 9 | 30 | +4% | +5% |
| 10 | 30 | +4% | +6% |
| 11 | 15 | +2% | +4% |

Table 1 shows an example of the individual diamond wheels included in the multicutter 55. The item "Diamond wheel No." in Table 1 indicates numbers of the individual diamond wheels which are arranged in parallel. The item "the number of machined groove parts" indicates the sums of the first groove parts 42 and the second groove parts 45 which the respective diamond wheels machine. The item "difference from the designed size" indicates differences of the width size of the first groove parts 42 and the second groove parts 45 formed by the respective diamond wheels from the designed width size of the first groove parts 42 and the second groove parts 45. The item "lower groove part" indicates differences around the bottom parts of the first groove parts 42 and the second groove parts 45 from the designed size. The item "upper groove part" indicates differences around the distal ends of the first groove parts 42 and the second groove parts 45 from the designed size.

Figure 9:
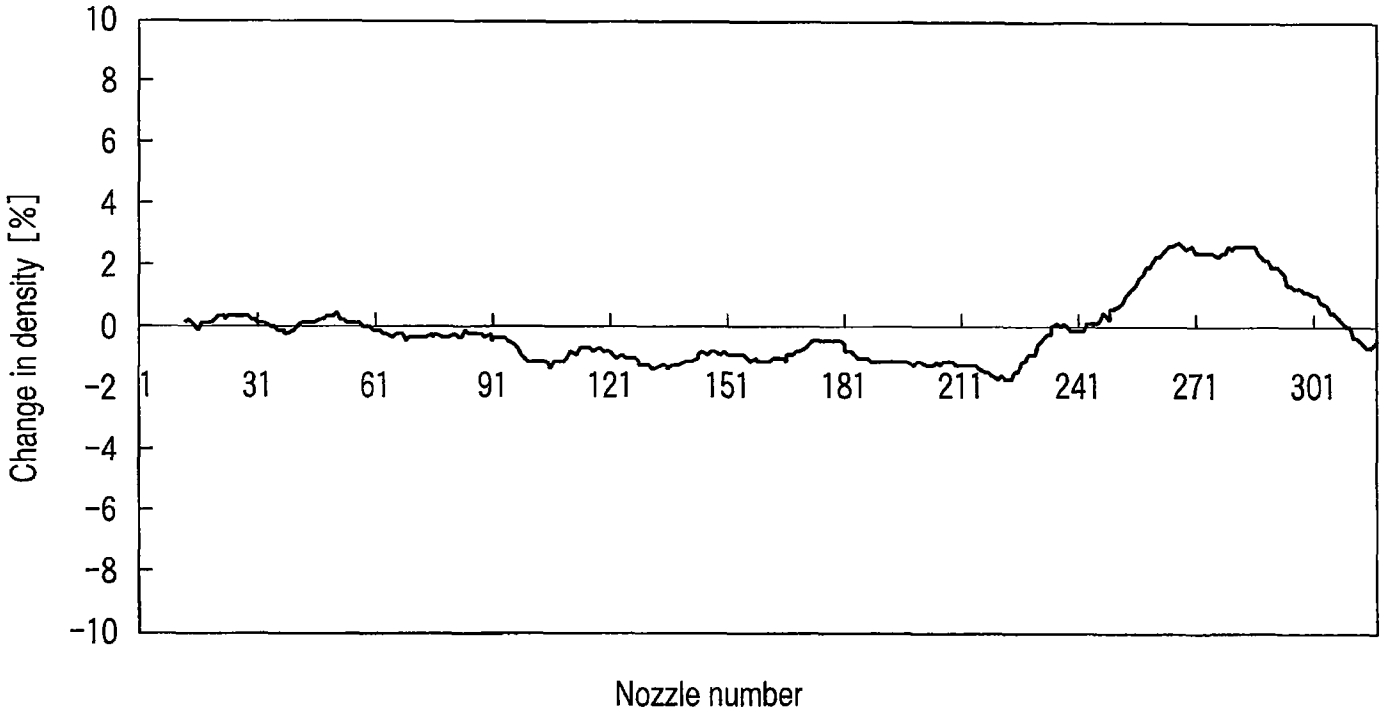
FIG. 9 is a graph illustrating an example of a printing result obtained by the inkjet head of the second embodiment.

FIG. 9 is a graph illustrating an example of a printing result by the inkjet head 10A having the above structure. In FIG. 9, the horizontal axis indicates numbers of the first nozzles 34 and the second nozzles 35 which are arranged in a line in an imaginary nozzle line 50. The vertical axis indicates difference between printing thickness obtained by each nozzle of the inkjet head 10A processed as described above and designed printing thickness of the nozzle. The printing thickness changes according to the size of the dot printed by each nozzle.

Figure 10:
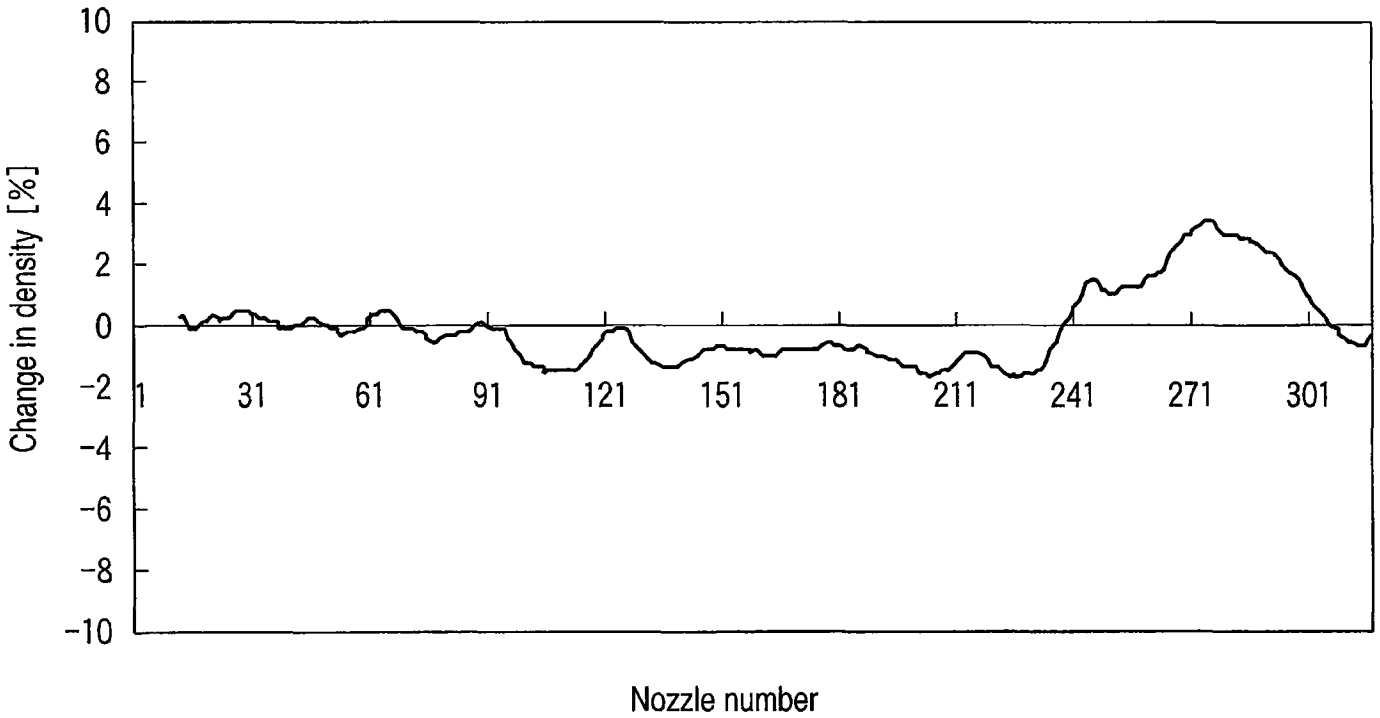
FIG. 10 is a graph illustrating an example of a printing result obtained by a general inkjet head.

On the other hand, FIG. 10 is a graph illustrating an example of a printing result by a general inkjet head. The general inkjet head is different from the inkjet head 10A of the above structure, in that one nozzle group is clearly divided from another nozzle group. Therefore, no parts which is printed with medium thickness by a boundary part between one nozzle group and another nozzle group exists between a part printed by one nozzle group and a part printed by another nozzle group.

As illustrated in FIG. 9, change in printing thickness by nozzles of the inkjet head 10A having the above structure is gentler than change in printing thickness by nozzles of the general inkjet head illustrated in FIG. 10. In other words, the inkjet head 10A having the above structure suppresses sudden change in printing thickness between one nozzle and another nozzle adjacent to the nozzle in the imaginary nozzle line 50. Thereby, unevenness in printing thickness due to difference in property between the individual diamond wheels is made inconspicuous.

On the other hand, each diamond wheel of the multicutter 55 deteriorates due to wearing in machining. Thereby, as machining is performed, difference in property occurs between the individual diamond wheels.

Figure 11:
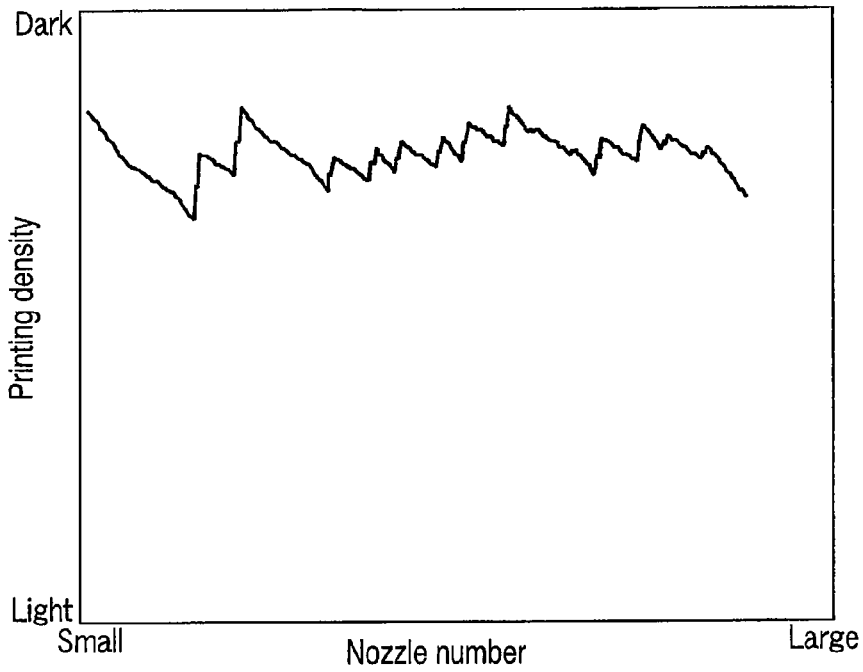
FIG. 11 is a graph illustrating an example of change in printing characteristic by the inkjet head according to the second embodiment.

FIG. 11 is a graph which schematically illustrates an example of change in printing property by the inkjet head 10A having the above structure. In FIG. 11, the horizontal axis indicates numbers of the first nozzles 34 and the second nozzles 35 which are arranged in a line in the imaginary nozzle line 50. The vertical axis indicates printing thickness by each nozzle of the inkjet head 10A processed as described above.

Figure 12:
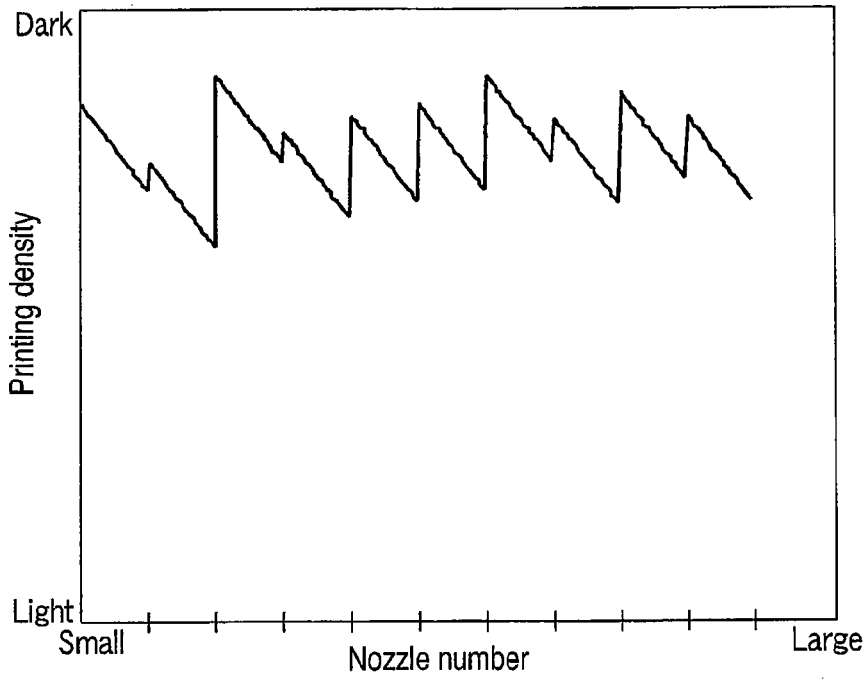
FIG. 12 is a graph illustrating an example of change in printing characteristic by the general inkjet head.

On the other hand, FIG. 12 is a graph which schematically illustrates an example of change in printing property by the above general inkjet head. The horizontal axis of FIG. 12 includes auxiliary division lines for respective nozzle groups. As illustrated in FIG. 12, according to the general inkjet head, the printing thickness in each nozzle group reduces as the nozzle number increases. Therefore, change in thickness between a part printed by one nozzle group and a part printed by another nozzle group is large.

In comparison with this, according to the inkjet head 10A having the above structure, change in density is reduced to small degree as illustrated in FIG. 11. As described above, even when difference in property between the individual diamond wheels occurs due to deterioration, unevenness in printing density is made inconspicuous.

The above first and second embodiments show the inkjet heads 10 and 10A which are manufactured by the multicutter 55. However, unevenness in printing thickness due to deterioration of the cutting edge is made inconspicuous also in inkjet heads manufactured by a single blade instead of the multicutter.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a substrate;

a plurality of piezoelectric members disposed on the substrate;

a nozzle plate disposed on the piezoelectric members, the nozzle plate including at least first and second nozzle lines, each of which includes a plurality of nozzles, wherein the nozzles included in the first nozzle line and the nozzles included in the second nozzle line are offset with respect to each other in a direction parallel to each of the nozzle lines; and a plurality of groove parts provided in each of the piezoelectric members, the groove parts corresponding to the nozzles and configured to eject ink through the nozzles, wherein a first groove part which corresponds to a first nozzle and a second groove part which corresponds to a second nozzle closest to the first nozzle is formed by different cutting edges, the groove parts include a first groove group of groove parts formed by one of the cutting edges, the first groove group corresponding to a first nozzle group, and a second groove group of groove parts formed by another of the cutting edges, the second grove group corresponding to a second nozzle group, the nozzles located in an end part of the first nozzle group and the nozzles located in an end part of the second nozzle group are offset with respect to each other in a direction parallel to each of the nozzle lines, and the groove parts extend along straight lines in a direction oblique to a direction in which the piezoelectric members extend.

2. The inkjet head of claim 1, wherein groove parts provided in a first of the piezoelectric members and groove parts provided in a second of the piezoelectric members which is adjacent to the first of the piezoelectric members extend along the same straight lines.

3. An inkjet head comprising:

a substrate;

a plurality of piezoelectric members disposed on the substrate;

a nozzle plate disposed on the piezoelectric members, the nozzle plate including at least first and second nozzle lines, each of which includes a plurality of nozzles, wherein the nozzles included in the first nozzle line and the nozzles included in the second nozzle line are offset with respect to each other in a direction parallel to each of the nozzle lines; and a plurality of groove parts provided in each of the piezoelectric members, the groove parts corresponding to the nozzles and configured to eject ink through the nozzles, wherein a first groove part which corresponds to a first nozzle and a second groove part which corresponds to a second nozzle closest to the first nozzle are formed by different cutting edges, and the groove parts extend along straight lines in a direction oblique to a direction in which the piezoelectric members extend.

4. The inkjet head of claim 3, wherein groove parts provided in a first of the piezoelectric members and groove parts provided in a second of the piezoelectric members which is adjacent to the first of the piezoelectric members extend along the same straight lines.

5. The inkjet heat of claim 4, wherein the groove parts include a first groove group which includes a plurality of groove parts formed by one of the cutting edges, the first groove group corresponding to a first nozzle group, and a second groove group which includes a plurality of groove parts formed by another of the cutting edges, the second grove group corresponding to a second nozzle group, and the nozzles located in an end part of the first nozzle group and the nozzles located in an end part of the second nozzle group are offset with respect to each other in a direction parallel to each of the nozzle lines.

6. An inkjet head comprising:

a substrate;

a nozzle plate including a first nozzle line which includes a plurality of first nozzles and a second nozzle line which includes a plurality of second nozzles, wherein the nozzles included in the first nozzle line and the nozzles included in the second nozzle line are offset with respect to each other in a direction parallel to each of the nozzle lines;

a first piezoelectric member disposed between the substrate and the nozzle plate and including a plurality of first groove parts each of which corresponds to a respective first nozzle and is configured to eject ink through the respective first nozzle; and a second piezoelectric member disposed between the substrate and the nozzle plate and including a plurality of second groove parts each of which corresponds to a respective second nozzle and is configured to elect ink through the respective second nozzle, wherein the first groove parts extend along straight lines in a direction oblique to a direction in which the first piezoelectric member extends, the second groove parts extend along straight lines in a direction oblique to a direction in which the second piezoelectric member extends, and one of the first groove parts and one of the second groove parts extend along one of the straight lines, at least one of the first nozzles being arranged between a first nozzle corresponding to said one of the first groove parts and a first nozzle closest to said one of the second groove parts, and at least one of the second nozzles being arranged between a second nozzle corresponding to said one of the second groove parts and a second nozzle closest to said one of the first groove parts.

7. The inkjet head of claim 6, wherein another one of the first groove parts and another one of the second groove parts extend along another one of the straight lines.

8. The inkjet head of claim 7, wherein the first groove parts and the second groove parts are formed by a plurality of cutting edges, and one of the first groove parts which corresponds to one of the first nozzles and one of the second groove parts which corresponds to one of the second nozzles closest to the one first nozzle are formed by different cutting edges.

9. The inkjet head of claim 8, wherein the first groove parts include a first groove group of first groove parts formed by one of the cutting edges, and a second groove group of first groove parts formed by another of the cutting edges, the second groove parts include a third groove group of second groove parts formed by the one of the cutting edges, and a fourth groove group of second groove parts formed by the another of the cutting edges, a first nozzle group corresponds to the first groove group and the third groove group, and a second nozzle group corresponds to the second groove group, and the nozzles located in an end part of the first nozzle group and the nozzles located in an end part of the second nozzle group are offset with respect to each other in a direction parallel to each of the nozzle lines.

10. The inkjet head of claim 8, wherein the first groove parts include a first groove group of first groove parts formed by one of the cutting edges, and a second groove group of first groove parts formed by another of the cutting edges, the second groove parts include a third groove group of second groove parts formed by the one of the cutting edges, and a fourth groove group of second groove parts formed by another of the cutting edges, a first nozzle group corresponds to the first groove group and the third groove group, a second nozzle group which corresponds to the second groove group, and a third nozzle group which corresponds to the fourth groove group, and the nozzles located in an end part of the first nozzle group and the nozzles located in an end part of the third nozzle group are offset with respect to each other in a direction parallel to each of the nozzle lines.

* * * * *